US008490588B2

(12) United States Patent
Nakamura

(10) Patent No.: US 8,490,588 B2
(45) Date of Patent: Jul. 23, 2013

(54) ACTUATOR DEVICE AND VARIABLE VALVE APPARATUS OF INTERNAL COMBUSTION ENGINE

(75) Inventor: Makoto Nakamura, Isehara (JP)

(73) Assignee: Hitachi, Ltd., Tokyo (JP)

( * ) Notice: Subject to any disclaimer, the term of this patent is extended or adjusted under 35 U.S.C. 154(b) by 1058 days.

(21) Appl. No.: 12/491,614

(22) Filed: Jun. 25, 2009

(65) Prior Publication Data

US 2010/0012062 A1 Jan. 21, 2010

(30) Foreign Application Priority Data

Jul. 17, 2008 (JP) ..... 2008-185576

(51) Int. Cl.
*F01L 1/34* (2006.01)

(52) U.S. Cl.
USPC ..... 123/90.16; 123/90.15; 123/90.11

(58) Field of Classification Search
USPC ..... 123/90.15, 90.16, 90.18, 90.11
See application file for complete search history.

(56) References Cited

U.S. PATENT DOCUMENTS

| | | | | |
|---|---|---|---|---|
| 6,244,229 | B1 | 6/2001 | Nakano et al. | |
| 6,550,437 | B2 * | 4/2003 | Nakamura et al. | 123/90.16 |
| 6,615,777 | B2 * | 9/2003 | Grau | 123/90.16 |
| 7,047,921 | B2 * | 5/2006 | Nakamura et al. | 123/90.16 |
| 7,215,113 | B2 | 5/2007 | Kinoshita | |
| 7,484,485 | B2 | 2/2009 | Nakamura et al. | |
| 2001/0023674 | A1 * | 9/2001 | Shimizu et al. | 123/90.18 |

FOREIGN PATENT DOCUMENTS

| | | | |
|---|---|---|---|
| JP | 2000-080907 | A | 3/2000 |
| JP | 2000-087712 | A | 3/2000 |
| JP | 2001-248410 | A | 9/2001 |
| JP | 2003-035115 | A | 2/2003 |
| JP | 2004-076619 | A | 3/2004 |
| JP | 2005-330942 | A | 12/2005 |
| JP | 2006-029208 | A | 2/2006 |
| JP | 2007-285306 | A | 11/2007 |
| JP | 2007-285308 | A | 11/2007 |
| JP | 2007-327363 | A | 12/2007 |
| JP | 2008-031952 | A | 2/2008 |

* cited by examiner

*Primary Examiner* — Thomas Denion
*Assistant Examiner* — Daniel Bernstein
(74) *Attorney, Agent, or Firm* — Foley & Lardner LLP

(57) ABSTRACT

There is provided an actuator device for a variable valve apparatus. The variable valve apparatus has a control shaft to vary operation characteristics of an engine valve by an axial movement thereof. The actuator device has a rotatable screw shaft, a movable member axially movable with rotation of the screw shaft and a transmission mechanism unit that converts an axial movement of the movable member to the axial movement of the control shaft. An amount of the axial movement of the movable member is larger than an amount of the axial movement of the control shaft.

17 Claims, 14 Drawing Sheets

ACTUATOR DEVICE AND VARIABLE VALVE APPARATUS OF INTERNAL COMBUSTION ENGINE

BACKGROUND OF THE INVENTION

The present invention relates to an actuator device, particularly suitable for use in a variable valve apparatus of an internal combustion engine.

A variable valve apparatus is commonly used in an internal combustion engine to vary the operating characteristics such as valve lift amounts of engine valves. Japanese Laid-Open Patent Publication No. 2005-330942 discloses one such type of variable valve apparatus that varies the valve lift amounts of engine intake valves. This variable valve apparatus includes a support pipe (rocker shaft) mounted by journals on a cylinder block of the engine, a drive shaft (control shaft) slidably inserted in the support pipe, an arm assembly disposed on an outer peripheral surface of the support pipe and provided with an input arm, an oscillation cam and a slider gear unit per engine cylinder and an actuator device for moving the drive shaft axially so as to move the slider gear unit in an axial direction of the drive shaft, change a relative phase difference between the input arm and the oscillation cam and thereby control the valve lift amount of the engine valve. In Japanese Laid-Open Patent Publication No. 2005-330942, the actuator device has an electric motor and a ball screw mechanism with a screw shaft and a ball nut so that, when the ball nut rotates upon energization of the electric motor, the ball screw mechanism converts the rotation of the ball screw nut to an axial movement of the screw shaft and transmits the axial movement to the drive shaft.

SUMMARY OF THE INVENTION

In the above-disclosed type of variable valve apparatus, the journals of the support pipe are arranged at positions between the engine cylinders; and the arm assemblies are arranged at positions corresponding to the respective engine cylinders. Such an arrangement however results in a small spacing between the journals of the support pipe and a limited axial length of the arm assembly due to relatively close location of the engine cylinders so that the slider gear unit cannot be moved largely in the axial direction. Namely, the axial movement amount of the drive shaft is limited to a small amount of about 5 to 20 mm (e.g. about 7 mm). It is thus difficult to increase the overall rotation speed of the electric motor for moving the drive shaft axially between minimum and maximum lift positions, i.e., difficult to increase the reduction ratio of the electric motor. This leads to excessive load torque in the motor and causes technical problems such as increase in power consumption for holding the given valve lift characteristics and deterioration in holding stability.

It is therefore an object of the present invention to provide an actuator device capable of reducing its drive load so as to, when applied to a variable valve apparatus of an internal combustion engine, obtain improvements in power consumption and holding stability.

According to a first aspect of the present invention, there is provided an actuator device for a variable valve apparatus, the variable valve apparatus having a control shaft to vary operation characteristics of an engine valve by an axial movement thereof, the actuator device comprising: a rotatable screw shaft; a movable member axially movable with rotation of the screw shaft; and a transmission mechanism unit that converts an axial movement of the movable member to the axial movement of the control shaft, wherein an amount of the axial movement of the movable member is larger than an amount of the axial movement of the control shaft.

According to a second aspect of the present invention, there is provided an actuator device for moving a control shaft in an axial direction thereof to control operating characteristics of an engine valve, comprising: a transmission shaft rotatably supported in a direction substantially perpendicular to the control shaft; a screw shaft rotatably supported in a direction substantially perpendicular to the transmission shaft; a drive unit that rotates the screw shaft; a movable member axially movable with rotation of the screw shaft; a first transmission mechanism that converts rotation of the transmission shaft to an axial movement and transmits the axial movement to the control shaft; and a second transmission mechanism that converts an axial movement of the movable member to rotation and transmit the rotation to the transmission shaft.

According to a third aspect of the present invention, there is provided an actuator device for moving a control shaft in an axial direction thereof to vary operating characteristics of an engine valve, comprising: a drive unit that outputs a power; and first and second transmission mechanisms located on a power transmission path between the control shaft and the drive unit so as to transmit the power from the drive unit to the control shaft, wherein the first and second transmission mechanisms have different power input/output characteristics.

The other objects and features of the present invention will also become understood from the following description.

DESCRIPTION OF THE EMBODIMENTS

Figure 1:
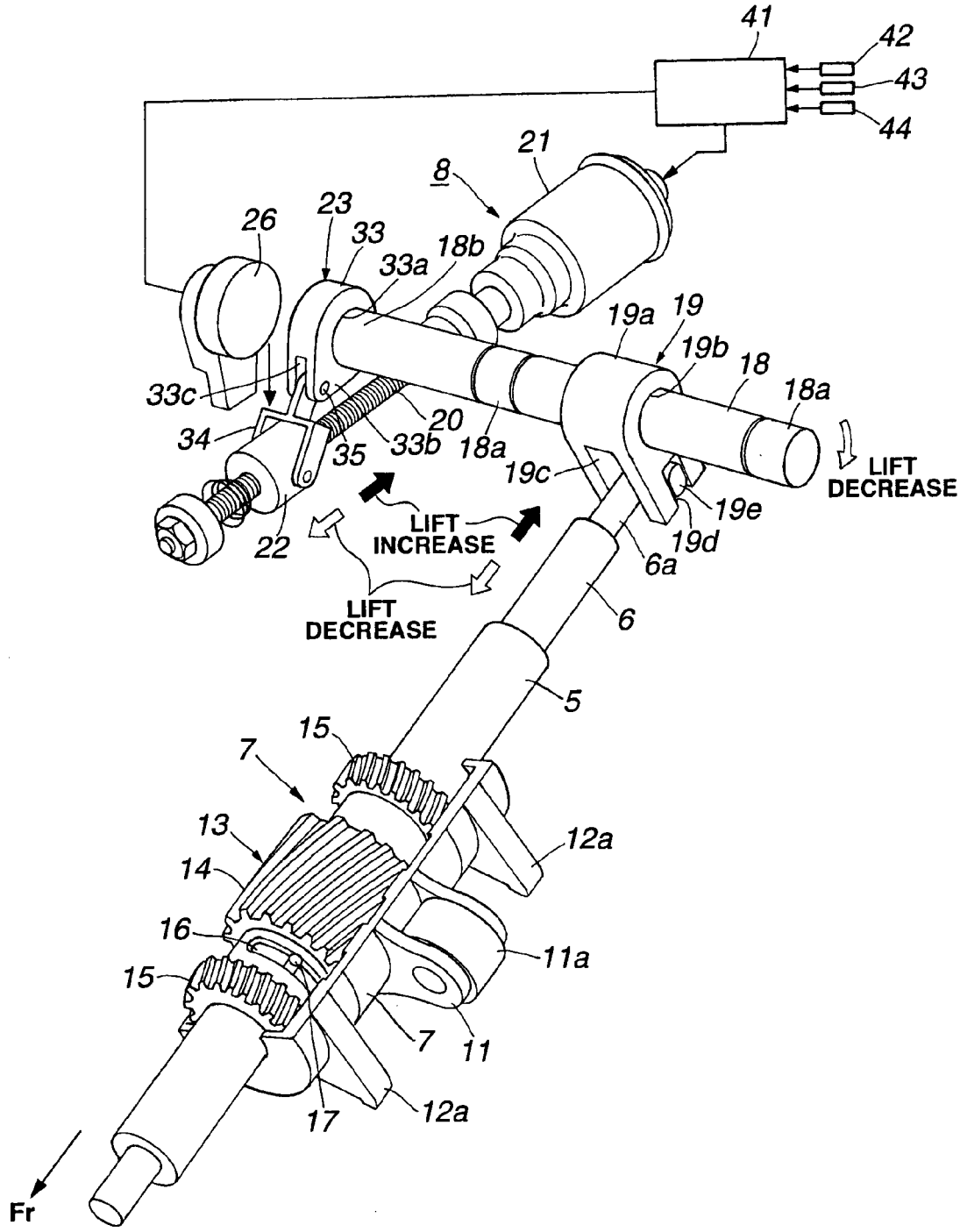
FIG. 1 is a perspective view of a variable valve apparatus equipped with an actuator device according to a first embodiment of the present invention.

The present invention will be described in detail below with reference to the following first to eighth embodiments, each of which refers to a variable valve system for varying operating characteristics such as a valve lift amount, opening/closing timing etc. of an engine valve in an internal combustion engine. In the first to eight embodiments, like parts and portions are designated by like reference numerals to avoid repeated explanations thereof.

First Embodiment

Figure 2A:
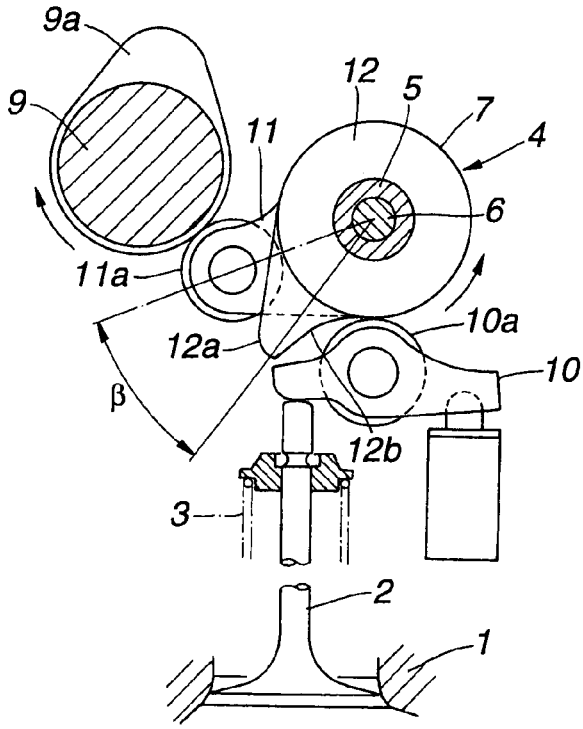
FIGS. 2A and 2B are cross-sectional views of the variable valve apparatus in valve closing and opening states during maximum valve lift control, respectively, according to the first embodiment of the present invention.
Figure 2B:
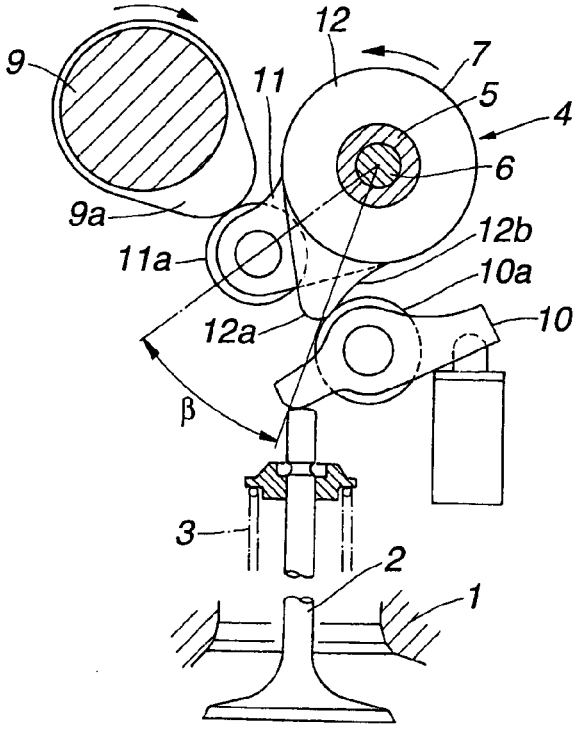

The variable valve system of the first embodiment employs a basic configuration as disclosed in Japanese Laid-Open Patent Publication No. 2008-031952. More specifically, the variable valve system includes a camshaft 9, a rocker arm 10 and a variable valve apparatus 4 disposed between the camshaft 9 and the rocker arm 10 and provided with a rocker shaft 5, a control shaft 6, an arm assembly 7 and an actuator device 8 so as to vary the valve lift amount and operating angle of each intake valve 2 in accordance with an operating state of the engine. In the first embodiment, two intake valves 2 are provided per engine cylinder. As shown in FIGS. 2A and 2B, each of the intake valves 2 is mounted on a cylinder head 1 of the engine by a valve guide and connected at a stem end thereof to the rocker arm 10. A valve spring 3 is attached to the stem end of the intake valve 2 so that the intake valve 2 is being biased by the valve spring 3 in a valve closing direction. Further, the engine cylinders are arranged in a row along the camshaft 9 in a longitudinal (front/rear) direction of the engine as indicated by an arrow Fr in FIG. 1.

The rocker shaft 5 is hollow cylindrical in shape and is axially immovably and unrotatably supported by journals on a plurality of partition walls of an upper portion of the engine cylinder head 1 so as to extend substantially in the longitudinal direction of the engine.

Figure 5A:
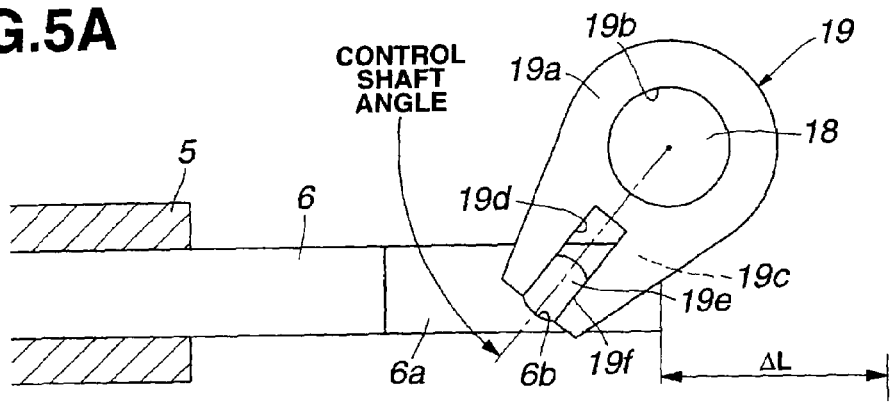
FIGS. 5A, 5B and 5C are schematic diagrams showing operating conditions of a first transmission mechanism of the actuator device and a control shaft of the variable valve apparatus during minimum valve lift control, medium valve lift control and maximum valve lift control, respectively, according to the first embodiment of the present invention.
Figure 5B:
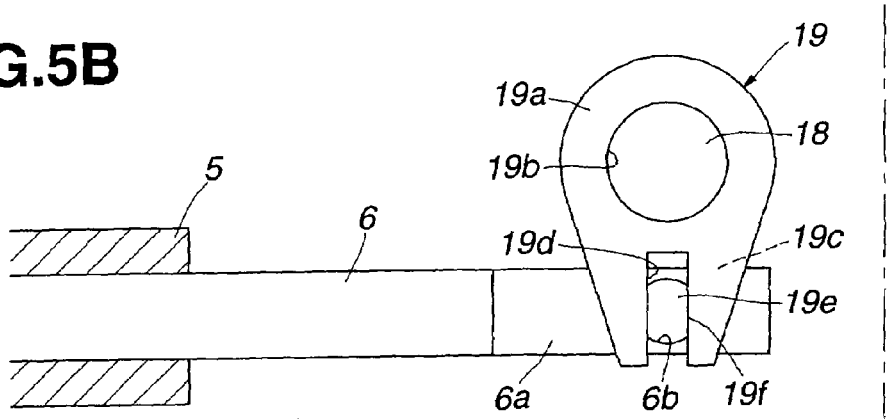
Figure 5C:
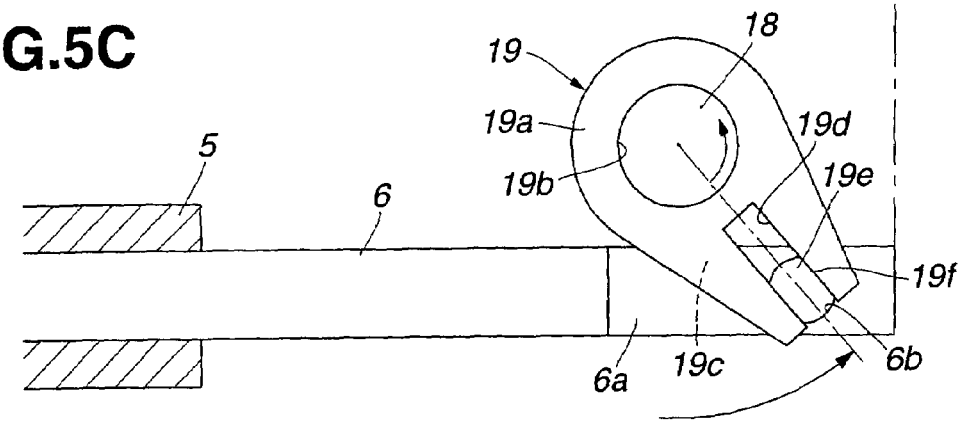

The control shaft 6 is slidably (movably) supported in an axial hole of the rocker shaft 5 with a relatively small-diameter end portion 6*a* thereof protruding from the rocker shaft 5 and connected to the actuator device 8. As shown in FIGS. 5A to 5C, the end portion 6*a* of the control shaft 6 is formed with a radial through hole 6*b* and two parallel flat cut surfaces. Also, an engagement pin 17 is formed as a protrusion integral with an outer peripheral surface of the control shaft 5 as shown in FIG. 1.

The arm assembly 7 is disposed on an outer peripheral surface of the rocker shaft 5 at a position between a drive cam 9*a* of the camshaft 9 and a roller 10*a* of the rocker arm 10 and provided with an input arm 11, two oscillation cams 12 and a slider gear unit 13 per engine cylinder.

The input arm 11 has an arm portion protruding outwardly from the outer peripheral surface of the rocker shaft 5 and a roller portion 11*a* formed on an end of the arm portion and held in rolling contact with an outer peripheral surface of the drive cam 9*a*.

Each of the oscillation cams 12 has a substantially triangular nose portion 12*a* protruding away from the outer peripheral surface of the rocker shaft 5 and a concave cam surface 12*b* formed on a bottom side of the nose portion 12*a*. The roller 10*a* is urged onto the cam surface 12*b* by a spring force of the valve spring 3.

When the drive cam 9*a* pushes the roller portion 11*a* of the input arm 11 upon rotation of the camshaft 9, the input arm 11 and the oscillation cam 12 oscillate together around the center of the control shaft 6 (rocker shaft 5) so as to move the rocker arm 10 and thereby open and close the intake valve 2.

The slider gear unit 13 is rotatably and axially slidably supported on the outer peripheral surface of the rocker shaft 5 and accommodated in a space defined by inner peripheral surfaces of the input arm 11 and the oscillation cams 12. The slider gear unit 13 has a right-hand helical gear 14 located on an axially middle portion thereof and a pair of left-hand helical gears 15 located on opposite sides of the helical gear 14. These helical gears 14 and 15 mesh with corresponding helical splines in the inner peripheral surfaces of the input arm 11 and the oscillation cams 12. A circumferentially elongated pin hole 16 is formed through the slider gear unit 16 at a position between the helical gear 14 and the helical gear 15 so as to overlap an axially elongated pin hole of the rocker shaft 5 and allow the engagement pin 17 to protrude outwardly through the overlap of the circumferentially elongated pin hole 16 and the axially elongated pin hole.

When the control shaft 6 moves axially with the engagement pin 17, the engagement pin 17 pushes the slider gear unit 13 and moves the helical gears 14 and 15 simultaneously in the axial direction of the control shaft 6. With these axial movements of the helical gears 14 and 15, the input arm 11 and the oscillation cams 12 do not move axially but rotate about the center of the control shaft 6 through the mesh of the helical splines and the helical gears 14 and 15. As the helical spline of the input arm 11 and the helical spline of the oscillation cam 12 are opposite in direction, the input arm 11 and the oscillation cam 12 rotate in opposite directions so as to change a relative phase difference (phase angle) β between the input arm 11 and the oscillation cam 12 and vary the valve lift amount and operation angle of the intake valve 2 depending on the phase angle β between the input arm 11 and the oscillation cam 12.

The actuator device 8 is coupled to the end portion 6*a* of the control shaft 6 so as to move the control shaft 6 axially linearly within a given movable range.

Figure 3:
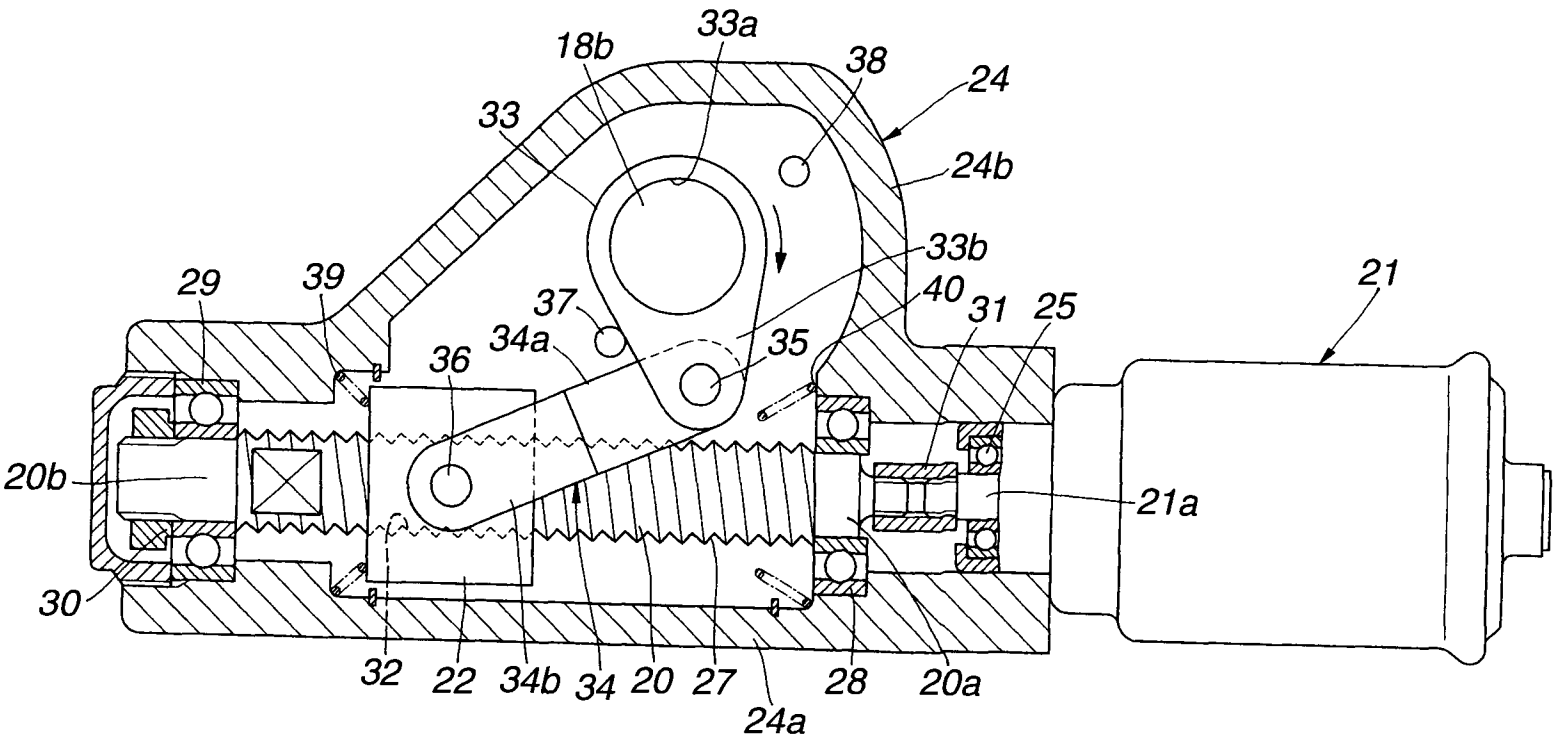
FIGS. 3 and 4 are cross-sectional views of the actuator device during minimum and maximum valve lift controls, respectively, according to the first embodiment of the present invention.
Figure 4:
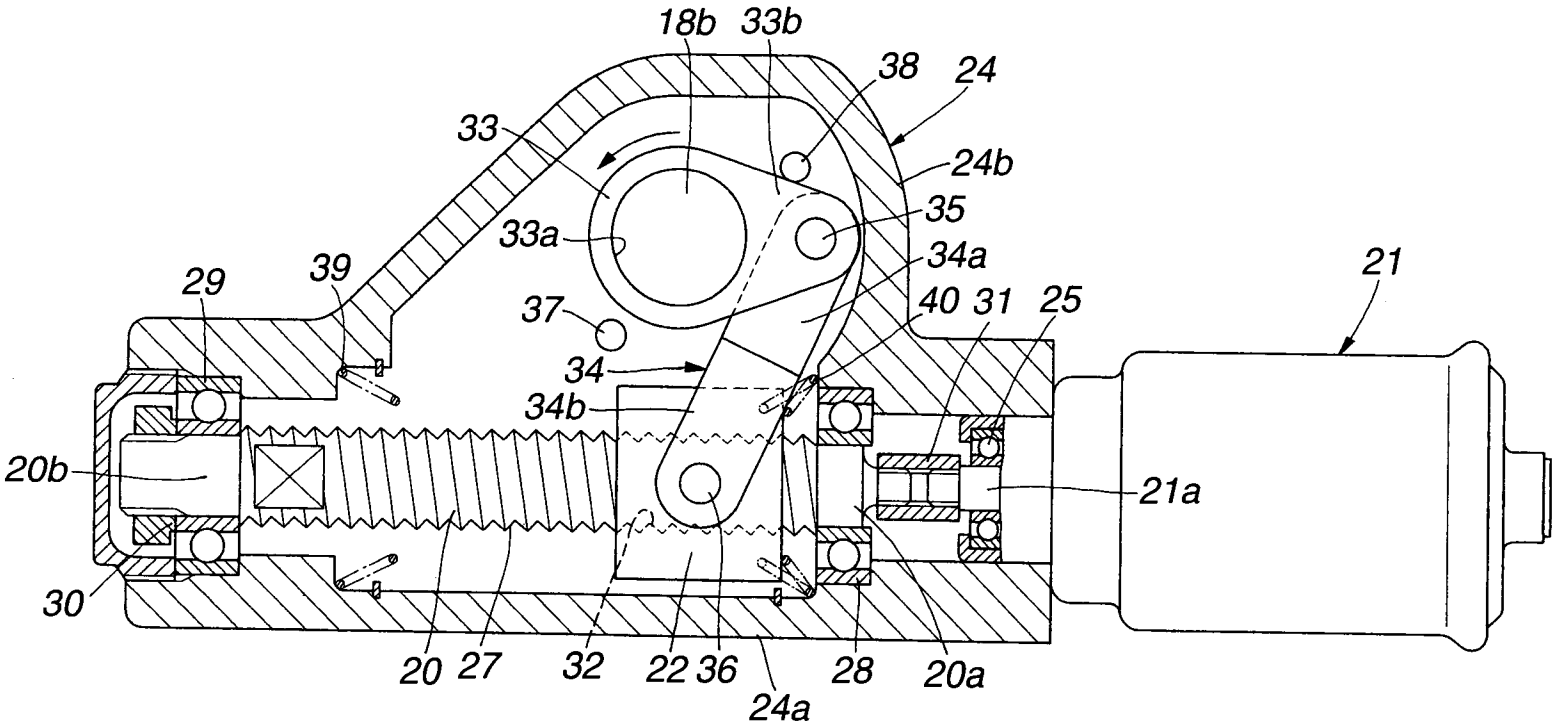

As shown in FIGS. 1, 3 and 4, the actuator device 8 includes a transmission shaft 18, a first transmission mechanism 19, a housing 24, a screw shaft 20, an electric motor 21 (as a drive unit), a screw nut 22 (as a movable member), a second transmission mechanism 23, a controller 41 and various detection units.

The transmission shaft 18 is rotatably supported in a lateral direction of the engine, i.e., in a direction substantially perpendicular to the control shaft 6 (rocker shaft 5). As shown in FIG. 1, journals 18*a* are formed on the transmission shaft 18 on opposite sides of the first transmission mechanism 19 so as to increase the rigidity to support the first transmission mechanism 19 for improvement in valve lift characteristics control accuracy.

The first transmission mechanism 19 is disposed between the control shaft 6 and the transmission shaft 18 so as to convert rotation of the transmission shaft 18 into an axial linear movement and transmit the axial linear movement to the control shaft 6. In the first embodiment, the first transmission mechanism 19 includes a link lever 19*a* supported on the transmission shaft 18 and a connection pin 19*e* connecting the link lever 19*a* to the control shaft 6 as shown in FIGS. 1 and 5A to 5C.

The link lever 19*a* has a raindrop-like shape with a cylindrical base portion and an outwardly protruding portion when viewed from the side (i.e. viewed in the axial direction of the transmission shaft 18). A press-fit hole 19*b* is formed axially through the cylindrical base portion of the link lever 19*a* so that the transmission shaft 18 is press-fitted through the press-fit hole 19*b*. On the other hand, a slit-shaped engagement groove 19*c* is formed in the protruding portion of the link lever 19*a* in the axial direction of the control shaft 6 (perpendicular to the axial direction of the transmission shaft 18) so that the end portion 6*a* of the control shaft 6 is engaged in the engagement groove 19*c*. U-shaped engagement grooves 19*d* are also formed in the protruding portion of the link lever 19*a* in the axial direction of the transmission shaft 18.

The connection pin 19*e* has a cylindrical portion rotatably engaged in the through hole 6*b* of the control shaft 6 and two end portions located on opposite sides of the cylindrical portion protrudingly from the end portion 6*a* of the control shaft 6 and engaged in the engagement grooves 19*e*. Each of the end portions of the connection pin 19*e* is formed with two parallel flat cut surfaces 19*f* so that the flat surfaces 19*f* are in sliding contact with the opposite lateral surfaces of the engagement groove 19*d*.

By the engagement of the connection pin 19*e* in the through hole 6*b* of the control shaft 6 and the engagement grooves 19*d* of the link lever 19*a*, the first transmission mechanism 19 mechanically forcibly moves the control shaft 6 in either axial direction without recourse to spring force etc. This enables quick and accurate switching/actuation of the control shaft 6.

Figure 6:
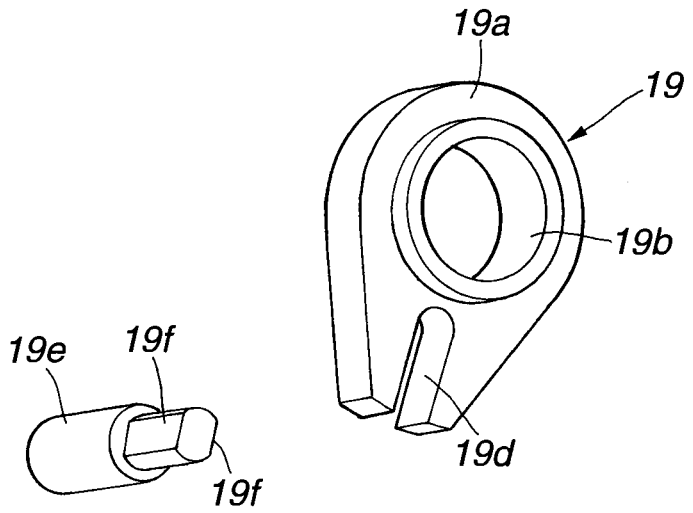
FIG. 6 a perspective exploded view of a modified form of the first transmission mechanism of the actuator device according to the first embodiment of the present invention.

The configuration of the first transmission mechanism 19 is not limited to the above. For example, the first transmission mechanism 19 can be modified such that: the link lever 19*a* has a relatively small width (thickness) with only one engagement groove 19*d*; and the connection pin 19*e* has only one end portion formed with two parallel flat surfaces 19*f* and engaged in the engagement groove 19*d* as shown in FIG. 6 for simple structure and easy manufacturing/assembling of the transmission mechanism 19.

The housing 24 is fixed to an end portion of the engine cylinder head 1 and, as shown in FIGS. 3 and 4, has a cylindrical portion 24*a* extending substantially perpendicular to the axial direction of the transmission shaft 18 and accommodating therein the screw shaft 20 and the like and an upwardly protruding portion 24*b* with an inner surface facing an end portion 18*b* of the transmission shaft 18.

The screw shaft 20 is arranged in the cylindrical portion 24*a* of the housing 24 in a direction substantially perpendicular to the transmission shaft 18 and substantially parallel to the control shaft 6 and rotatably supported at both ends 20*a* and 20*b* thereof by ball bearings 28 and 29 in opening ends of the cylindrical portion 24*a* of the housing 24.

With the substantially parallel arrangement of the control shaft 6 and the screw shaft 20 in the longitudinal direction of the engine i.e. the engine cylinder row direction, the actuator device 8 secures good mountability to the engine. The control shaft 6 and the screw shaft 20 may alternatively be arranged exactly in parallel to each other for easy alignment control.

As shown in FIGS. 3 and 4, an external thread 27 is formed continuously formed on an outer peripheral surface of the screw shaft 20 except the ends 20*a* and 20*b*. A nut 30 is screwed onto the end 20*b* of the screw shaft 20 and formed with a protrusion to push and fix an inner ring of the ball spring 29 against a stepped surface of the end 20*b* of the screw shaft 20 such that the nut 30 can rotate together with the screw shaft 20.

The electric motor 21 is located on an inner side of the transmission shaft 18 in the engine and driven under the control of the controller 41 so as to output a rotational power (torque) to the screw shaft 20. The configuration of the electric motor 21 is not particularly limited as long as the electric motor 21 is capable of rotating the screw shaft 20 in both directions. By way of example, the electric motor 21 is in the form of a proportional DC motor that has a substantially cylindrical casing and a motor shaft 21*a* substantially coaxial with the screw shaft 20 as shown in FIGS. 3 and 4 in the first embodiment. The motor casing is formed with a small-diameter end portion so that the small-diameter end portion of the casing is press-fitted in the opening end of the cylindrical portion 24*a* of the housing 24. The motor shaft 21*a* is supported by a ball bearing 25 in the small-diameter end portion of the motor casing and connected to the end portion 20*a* of the screw shaft 20 by a cylindrical serrated connection member 31 such that the serrated connection member 31 allows rotation of the screw shaft 20 about its center together with the motor shaft 21*a* and relative axial displacement between the screw shaft 20 and the motor shaft 21*a*.

The controller 41 is connected with the detection units and configured to determine the engine operating state by feedback of detection signals from the detection units and output a control signal (current signal) to drive the electric motor 21 in accordance with the engine operation state. In the first embodiment, the detection units include a crank angle sensor 42 for detecting a rotation speed of the engine, an air flow meter 43 for detecting an intake air amount of the engine, a coolant temperature sensor 44 for detecting a coolant temperature of the engine and a rotational potentiometer 26 arranged on one side of the transmission shaft 18 adjacent to the second transmission mechanism 23 for detecting an angular rotational position (rotation angle) of the transmission shaft 18 as shown in FIG. 1. With the use of the rotational potentiometer 26, the valve lift characteristics of the variable valve apparatus 4 can be monitored easily by detecting the rotation angle of the transmission shaft 18 rather than by detecting the axial movement amount of the control shaft 6.

The screw nut 22 is generally cylindrical in shape and is axially movably disposed on the screw shaft 20. As shown in FIGS. 3 and 4, an internal thread 32 is formed on an inner peripheral surface of the screw nut 22 and held in mesh with the external thread 27 of the screw shaft 20 so that the screw nut 22 can move axially on the screw shaft 20 between its movable limit positions (occasionally referred to as "minimum and maximum lift positions") with rotation of the screw shaft 20. Radial pin holes are also formed in opposite sides of the screw nut 22.

The second transmission mechanism 23 is disposed between the screw nut 22 and the transmission shaft 18 so as to convert an axial movement of the screw nut 22 to rotation and transmit the rotation to the transmission shaft 18. In the first embodiment, the second transmission mechanism 23 includes a connection arm 33 fixed to a peripheral edge of the end portion 18*b* of the transmission shaft 18 within the housing 24 and a link member 34 coupled to the connection arm 33 and the screw nut 22 by pins 35 and 36.

As shown in FIGS. 1, 3 and 4, the connection arm 33 has a raindrop-like shape with a large-diameter base portion and a tapered end portion 33*b*. A press-fit hole 33*a* is formed through the base portion of the connection arm 33 so that the end portion 18*b* of the transmission shaft 18 is press-fitted in the press-fit hole 33*a*. A slit 33*c* is formed in an outer periphery of the tapered end portion 33*b* of the connection arm 33 so as to divide the arm end portion 33*b* into two width areas on opposite sides of the slit 33*c*. Pin holes are formed through these two width areas of the arm end portion 33*b* in the axial direction of the transmission shaft 18.

The link member 34 has a Y-letter shape with a flattened end 34*a* and a bifurcated end 34*b* as shown in FIGS. 1, 3 and 4. The flattened end 34*a* of the link member 34 is fitted in the slit 33*c* of the connection arm 33. On the other hand, the bifurcated end 34*b* of the link member 34 is fitted on the screw nut 22. Pin holes are formed through the flattened and bifurcated ends 34*a* and 34*b* of the link members 34.

The pin 35 is inserted and fixed in the pin holes of the connection arm 33 and the pin hole of the flattened end 34*a* of the link member 34 so as to rotatably connect the flattened end 34*a* of the link member 34 to the end portion 33*b* of the connection arm 33. The pins 36 are inserted and fixed in the pin holes of the screw nut 22 and the pin holes of the bifurcated end 34*b* of the link member 34 so as to rotatably connect the bifurcated end 34*b* of the link member 34 to the screw nut 22. It is thus noted that: the pin 35 functions together with the connection arm 33 as a first connection member disposed on the transmission shaft 18 at a position radially away from the rotation center of the transmission shaft 18; and the pin 36 functions as a second connection member disposed on the screw nut 22 (movable member) and connected to the first connection member by the link member 34.

As shown in FIGS. 3 and 4, the actuator device 8 also includes first and second stopper pins 37 and 38 and coil springs 39 and 40 (as metal spring members).

The stopper pins 37 and 38 are disposed on a lateral inner wall of the housing 24 so as to restrict the maximum rotational positions of the transmission shaft 18 and set the minimum and maximum valve lift amounts of the intake valve 2 upon contact of the stopper pins 37 and 38 and the connection arm 33.

The coil springs 39 and 40 are substantially truncated conical in shape and disposed on stepped surfaces of the opening ends of the cylindrical portion 24*a* of the housing 24. When the screw nut 22 moves to the movable limit position, a small diameter portion of the coil spring 39, 40 comes into contact with the screw nut 22 so that the coil spring 39, 40 applies a spring force to the screw nut 22 at the time immediately before the contact of the connection arm 33 and the stopper pin 37, 38. When the screw nut 22 is in normal positions near the movable limit positions, the coil springs 39 and 40 are kept away from the screw nut and apply no spring force to the screw nut 22.

The above-structured variable valve apparatus 4 operates as follows.

Figure 7:
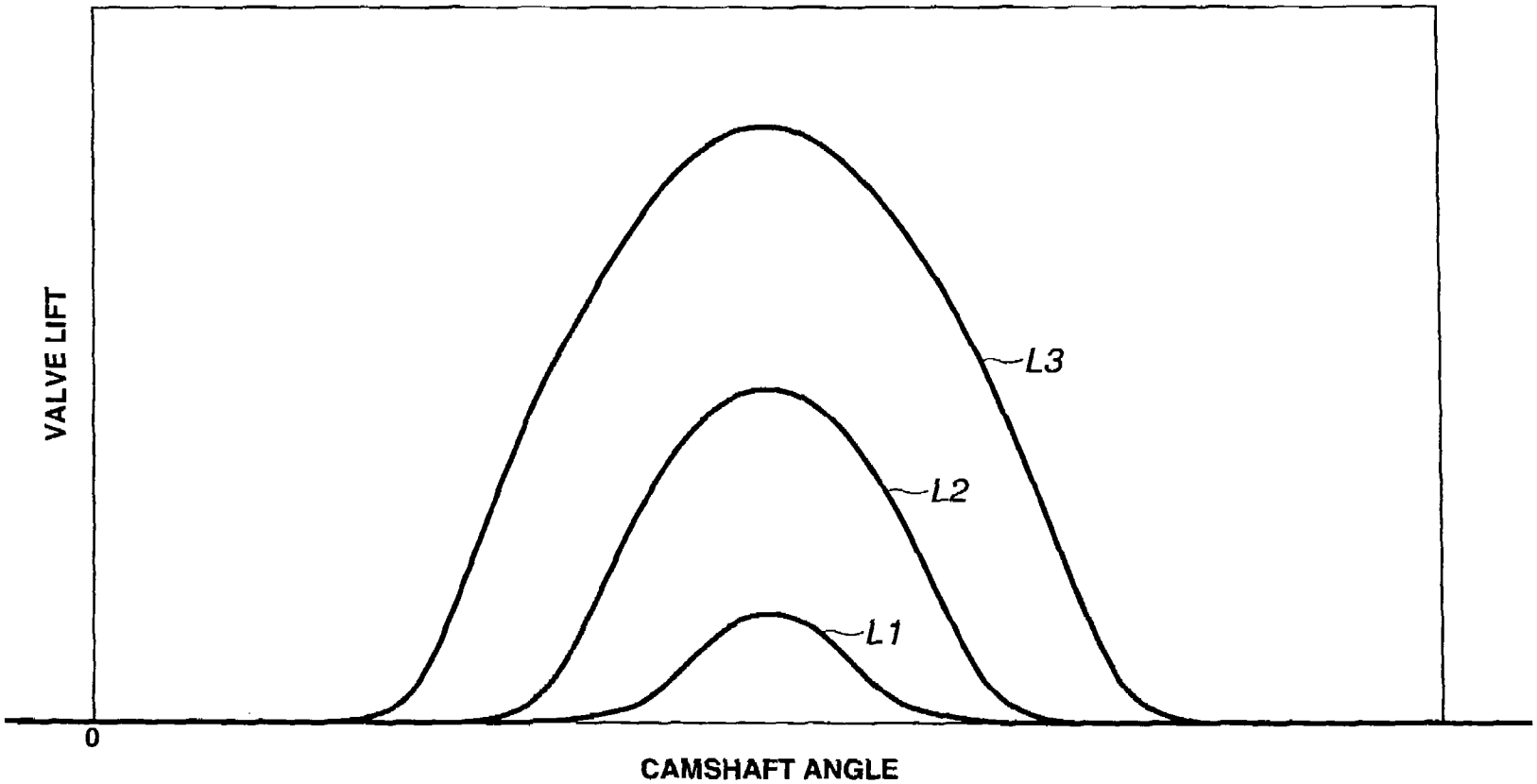
FIG. 7 is a diagram showing valve lift characteristics of the variable valve apparatus according to the first embodiment of the present invention.

In the case where the engine is in a low-speed operating state (including engine starting/idling operations), the electric motor 21 operates under the control signal from the controller 41 and rotates the screw shaft 20 in one direction. The screw nut 22 moves axially to its minimum lift position with the rotation of the screw shaft 20 as shown in FIG. 3. At this time, the first coil spring 39 gets compressed and deformed by the screw nut 22. The second transmission mechanism 23 actuates the connection arm 33 and the link member 34 with the axial movement of the screw nut 22, so as to rotate the transmission shaft 18 in a clockwise direction (indicated by an arrow) of FIG. 3 but prevent excessive clockwise rotation of the transmission shaft 18 by contact of the end portion 33*b* of the connection arm 33 with the first stopper pin 37. The first transmission mechanism 19 then actuates the link lever 19*a* with the rotation of the transmission shaft 18 so as to move the control shaft 6 axially to one limit position in the movable range (hereinafter referred to as "minimum lift position") as shown in FIG. 5A. As the engagement pin 17 moves axially together with the control shaft 6, the slider gear unit 13 moves the helical gears 14 and 15 in the same axial direction as the control shaft 6. The overall process of the above valve lift decrease operations is indicated by open/white arrows in FIG. 1. As a result, the oscillation cam 12 turns relative to the input arm 11 so as to minimize the phase angle β between the input arm 11 and the oscillation cam 12 and decrease the oscillation angle of the rocker shaft 10. The peak lift amount of the intake valve 2 is thus controlled to a minimum valve lift amount L1 in FIG. 7. Under such minimum valve lift control, the opening timing of the intake valve 2 becomes retarded to decrease the intake/exhaust valve overlap of the engine. It is accordingly possible to obtain improvement in fuel efficiency and achieve stable engine running performance in the low-speed engine operating state. Further, the coil spring 39 applies its spring force to the screw nut 22 immediately before the connection arm 33 comes into contact with the stopper pin 37. This provides a sufficient cushioning (shock absorbing) effect that protects the connection arm 33 from shock caused by the contact of the connection arm 33 to the stopper pin 37.

In the case where the engine shifts from the low-speed operating state to a middle-speed operating state for steady engine running, the electric motor 21 operates under the control signal from the controller 41 and rotates the screw shaft 20 in the opposite direction. The screw nut 22 moves axially to a middle position between its minimum and maximum lift positions with the rotation of the screw shaft 20. The second transmission mechanism 23 actuates the connection arm 33 and the link member 34 with the axial movement of the screw nut 22 so as to rotate the transmission shaft 18 in a counterclockwise direction of FIG. 3. The first transmission mechanism 19 then actuates the link lever 19*a* with the rotation of the transmission shaft 18 so as to move the control shaft 6 axially to a middle position in the movable range (hereinafter referred to as "medium lift position") as shown in FIG. 5B. As the engagement pin 17 moves axially together with the control shaft 6, the slider gear unit 13 moves the helical gears 14 and 15 in the same axial direction as the control shaft 6. The overall process of the above valve lift increase operations are indicated by filled/black arrows in FIG. 1. As a result, the oscillation cam 12 turns relative to the input arm 11 so as to increase the phase angle β between the input arm 11 and the oscillation cam 12 and increase the oscillation angle of the rocker shaft 10. The peak lift amount of the intake valve 2 is thus controlled to a medium valve lift amount L2 in FIG. 7. The intake/exhaust valve overlap of the engine becomes slightly increased under such medium valve lift control. It is accordingly possible to obtain improvements in fuel efficiency and engine torque in the middle-speed engine operating state.

In the case where the engine shifts from the middle-speed operating state to a high-speed operating state, the electric motor 21 operates under the control signal from the controller 41 and further rotates the screw shaft 20. The screw nut 22 moves axially to its maximum lift position with the rotation of the screw shaft 20 as shown in FIG. 4. At this time, the second coil spring 40 gets compressed and deformed by the screw nut 22. The second transmission mechanism 23 actuates the connection arm 33 and the link member 34 with the axial movement of the screw nut 22, so as to rotate the transmission shaft 18 in a counterclockwise direction (indicated by an arrow) of FIG. 4 but prevent excessive counterclockwise rotation of the transmission shaft 18 by contact of the end portion 33*b* of the connection arm 33 with the second stopper pin 38. The first transmission mechanism 19 then actuates the link lever 19*a* with the rotation of the transmission shaft 18 so as to move the control shaft 6 axially to the other limit position in the movable range (hereinafter referred to as "maximum lift position") as shown in FIG. 5C. As the engagement pin 17 moves axially together with the control shaft 6, the slider gear unit 13 moves the helical gears 14 and 15 in the same axial direction as the control shaft 6. As a result, the oscillation cam 12 turns relative to the input arm 11 so as to maximize the phase angle β between the input arm 11 and the oscillation cam 12 and increase the oscillation angle of the rocker shaft 10. The peak lift amount of the intake valve 2 is thus controlled to a maximum valve lift amount L3 in FIG. 7. Under such maximum valve lift control, the opening timing of the intake valve 2 becomes advanced to increase the intake/exhaust valve overlap of the engine. It is accordingly possible to secure sufficient engine output with increase in intake efficiency in the high-speed engine operating state. Further, the coil spring 40 applies its spring force to the screw nut 22 immediately before the connection arm 33 comes into contact with the stopper pin 38. This also provides a sufficient cushioning (shock absorbing) effect that protects the connection arm 33 from shock caused by the contact of the connection arm 33 to the stopper pin 38.

Herein, the following equation holds: $W=2\pi\times N\times T$ where W is the required conversion work; T is the average load torque of the electric motor 21; and N is the overall rotation speed of the electric motor 21. It is apparent from the above equation that, when the electric motor 21 causes a full axial movement ΔL of the control shaft 6 between the maximum and minimum lift positions so as to hold given valve lift characteristics, the load torque T of the electric motor 21 can be reduced with increase in the overall rotation speed N of the electric motor 21.

The arrangement of the variable valve apparatus 4 (in which the journals of the rocker shaft 5 are arranged at positions between the engine cylinders; and the arm assemblies 7 are arranged at positions corresponding to the respective engine cylinders) results in a small spacing between the journals of the rocker shaft 5 and a limited axial length of the arm assembly 7 due to relatively close location of the engine cylinders so that the slider gear unit 13 cannot be axially moved by so large an amount as mentioned above. Namely, the maximum possible axial movement amount ΔL(=Lmax−Lmin) of the control shaft 6 cannot be made so large and is limited to e.g. about 5 to 20 mm.

In the conventional actuator device in which the ball screw mechanism causes the rotation of the ball nut by the electric motor and directly converts the rotation of the ball nut to the axial movement of the control shaft through the screw shaft, however, such a limited axial movement amount of the control shaft corresponds to a small rotation angle of the ball nut or, equivalently, a low overall rotation speed of the electric motor. When the axial movement amount of the control shaft is 5 to 20 mm, for example, the overall rotation speed of the electric motor ranges from about 1.7 to 6.7 rpm (=5 to 20 mm/3 mm) for the reason that the ball screw shaft structurally requires a lead length of about 3 mm. This results in excessive drive load in the electric motor and causes deterioration in power consumption to hold the given valve lift characteristics and deterioration in holding stability.

In the first embodiment, by contrast, the actuator device 8 has a transmission mechanism unit consisting of the first and second transmission mechanisms 19 and 23 and located on a power transmission path between the control shaft 6 and the screw nut 22 so as to convert the axial movement of the screw nut 22 to the rotation of the transmission shaft 18 and then to the axial movement of the control shaft 6. The transmission mechanism unit has power input/output conversion characteristics that allows a relatively large rotation Δα of the transmission shaft 18 and then a relatively large axial movement ΔS of the screw nut 22 with respective to a relatively small axial movement ΔL of the control shaft 6. Even if the axial movement amount ΔL of the control shaft 6 is limited to 5 to 20 mm, the transmission mechanism unit makes it possible that the screw nut 22 secures a large axial movement amount ΔS of e.g. 40 to 60 mm so as to increase the overall rotation speed of the screw shaft 20 for the full axial movement of the screw nut 22 between the movable limit positions, i.e., increase the overall rotation speed of the electric motor 21 and increase the reduction ratio of the electric motor 21. For example, when the axial movement amount ΔL of the control shaft 6 is 5 to 20 mm, the overall rotation speed of the electric motor 21 is increased to a high level of about 1.7 to 6.7 rpm (=5 to 20 mm/3 mm) with a screw lead length of 3 mm. The load torque T of the electric motor 21 can be reduced to e.g. half the conventional level or lower.

Figure 8A:
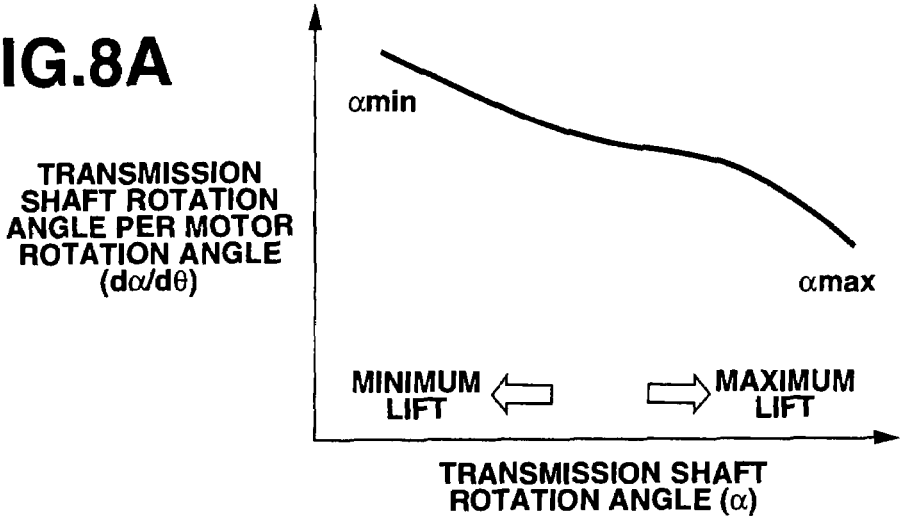
FIGS. 8A, 8B and 8C are diagrams showing power input/output conversion characteristics of the first and second transmission mechanisms of the actuator device according to the first embodiment of the present invention.
Figure 8B:
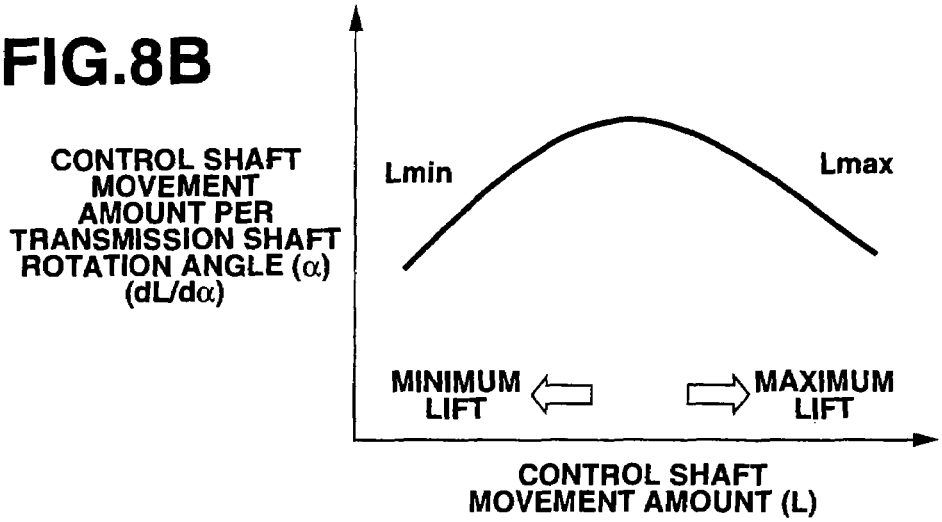

More specifically, the first and second transmission mechanisms 19 and 23 have different power input/output conversion characteristics as shown in FIGS. 8A and 8B. The conversion characteristics of the first and second transmission mechanisms 19 and 23 are herein expressed in terms of the axial movement amount (length) dL/dα of the control shaft 6 per rotation angle of the transmission shaft 18 and the rotation angle dα/dθ of the transmission shaft 18 per rotation angle of the electric motor 21, respectively, where α is the rotation angle of the transmission shaft 18; L is the axial movement amount of the control shaft 6; and θ is the rotation angle of the electric motor 21 which is in agreement with the rotation angle of the screw shaft 20.

When the control shaft 6 is in the region of the maximum lift position (referred to as "maximum valve lift control region"), the link member 34 is held in the direction substantially perpendicular to the screw shaft 20 as shown in FIG. 4 so that the axial movement of the screw nut 22 is not efficiently converted to the rotation of the transmission shaft 18. Thus, the parameter dα/dθ is relatively small in the maximum valve lift control region and decreases continuously and gradually as the position of the control shaft 6 changes from the minimum lift position to the maximum lift position.

When the control shaft 6 is in the maximum valve lift control region or in the region of the minimum lift position (referred to as "minimum valve lift control region), the direction of the link lever 19*a* gets closer to the direction of the control shaft 6 so that the rotation of the transmission shaft 18 is not efficiently converted to the axial movement of the control shaft 6 as shown in FIGS. 5A and 5C. As shown in FIG. 8B, the parameter dL/dα is thus relatively small in the minimum and maximum valve lift control regions. The parameter dL/dα increases as the position of the control shaft 6 changes from the minimum lift position to the middle lift position and decreases as the position of the control shaft 6 changes from the middle lift position to the maximum lift position.

Figure 8C:
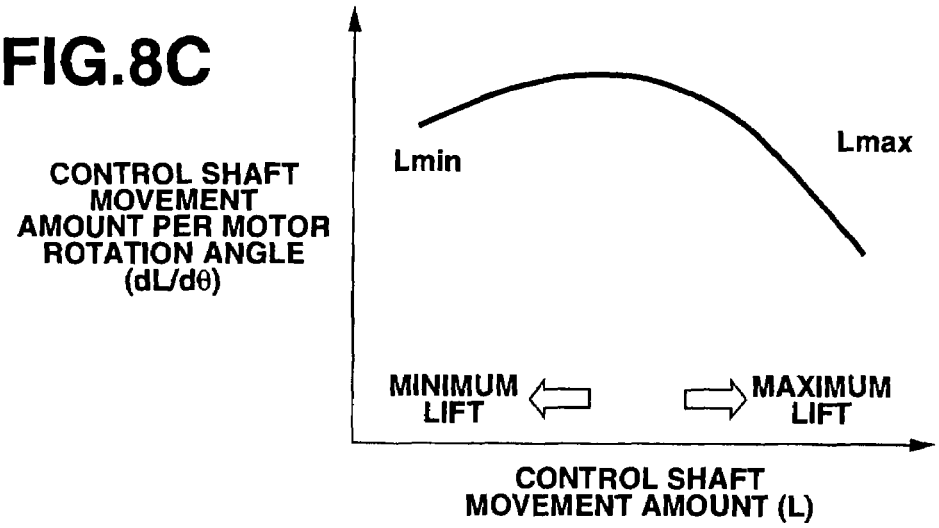

In consequence, the axial movement amount dL/dθ of the control shaft 6 per rotation angle of the electric motor 21, given as the resultant of the above two characteristic parameters dα/dθ and dL/dα, changes depending on the position of the control shaft 6 as shown in FIG. 8C. The parameter dL/dθ is set relatively small in the minimum and maximum valve lift control regions. It means that the speed of axial movement of the control shaft 6 decreases relative to the same rotation speed of the electric motor 21. This enables smooth conversion finish and decreases or prevents so-called overshoot in the minimum and maximum valve lift control regions. The above effect is particularly large when the parameter dL/dθ is minimized at the maximum lift position where the input is large. The parameter dL/dθ is set relatively large and maximized at around the medium lift position. This provides improvement in conversion response in the medium valve lift control region.

As explained above, the first and second transmission mechanisms 19 and 23 are located on the power transmission path between the control shaft 6 and the screw nut 22 in the actuator device 8. The axial movement amount ΔS of the screw nut 22 is set large with respect to the axial movement amount ΔL of the control shaft 22 by these transmission mechanisms 19 and 23 whereby the actuator device 8 is capable of increasing the overall rotation speed of the electric motor 21 for the full axial movement of the control shaft 6 between the maximum and minimum lift positions (i.e. increasing the reduction ratio of the electric motor 21) and reducing the drive load of the electric motor 21 to prevent excessive drive load in the electric motor 21. It is therefore possible to hold the given valve lift characteristics with improved power consumption and holding stability.

Second Embodiment

Figure 9A:
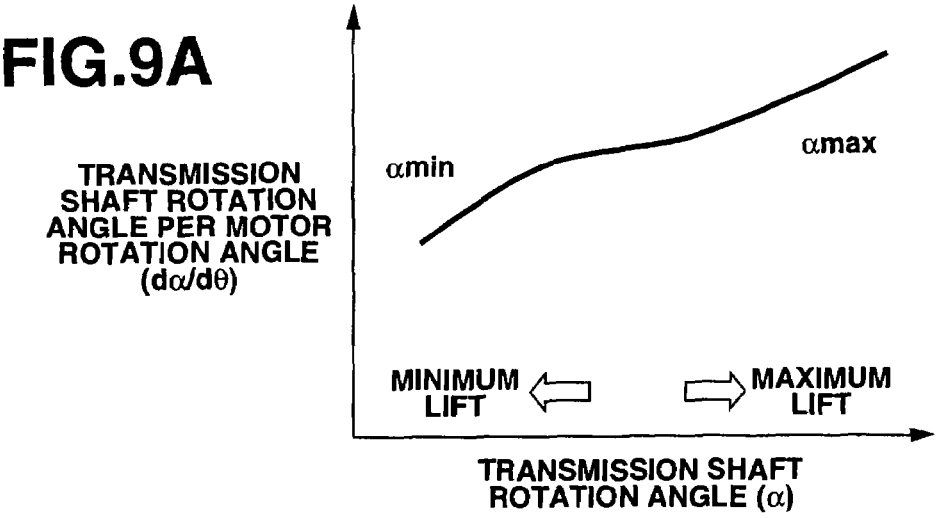
FIGS. 9A, 9B and 9C are diagrams showing power input/output conversion characteristics of first and second transmission mechanisms of an actuator device according to a second embodiment of the present invention.
Figure 9B:
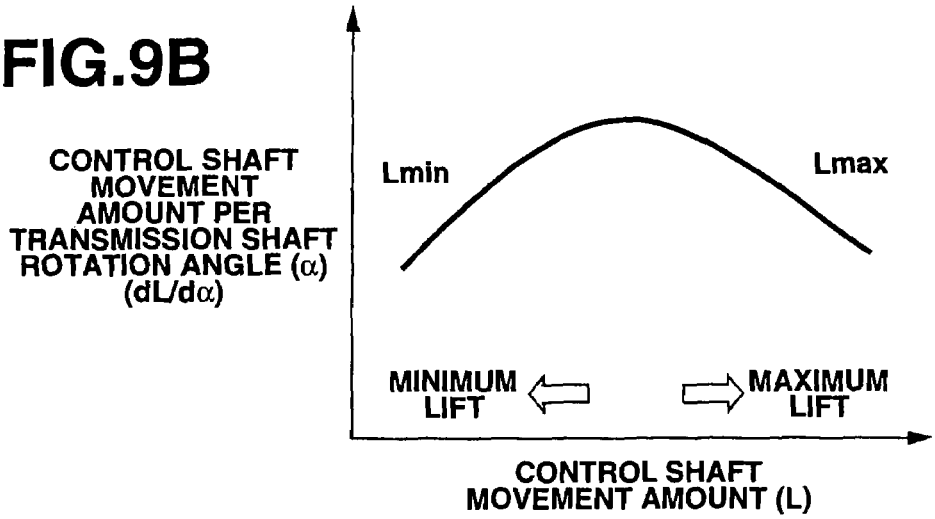
Figure 9C:
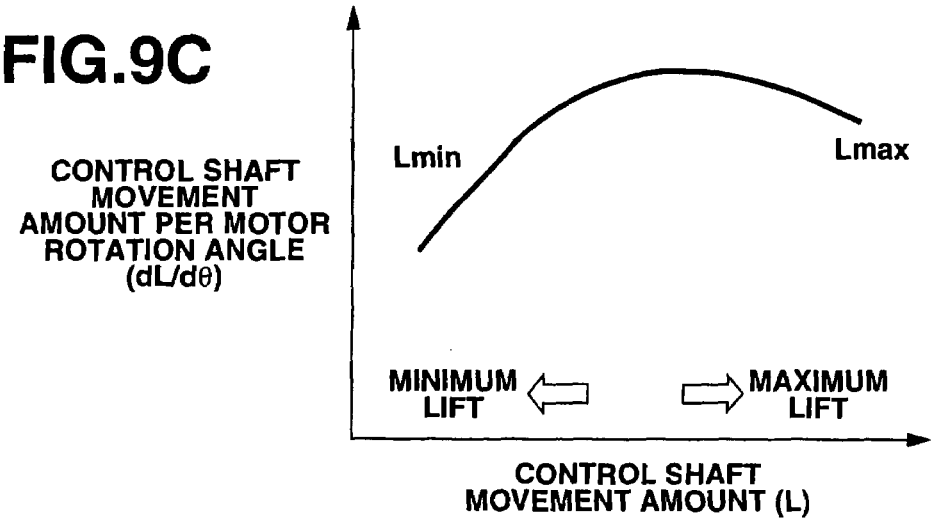

The second embodiment is structurally similar to the first embodiment, except the minimum and maximum lift positions of the screw nut 22 and the location of the electric motor 21. In the second embodiment, the minimum and maximum lift positions of the screw nut 22 and the location of the electric motor 21 are set in reverse (as in a mirror reflection) to those in the first embodiment. With this configuration, the second transmission mechanism 23 of the second embodiment has power input/output conversion characteristics opposite to those the first embodiment. As shown in FIG. 9A, the rotation angle dα/dθ of the transmission shaft 18 per rotation angle of the electric motor 21 increases continuously and gradually as the position of the control shaft 6 changes from the minimum lift position to the maximum lift position. By contrast, the first transmission mechanism 19 has power input/output conversion characteristics similar to those of the first embodiment. The axial movement amount dL/dα of the control shaft 6 per rotation angle of the transmission shaft 18 increases as the position of the control shaft 6 changes from the minimum lift position to the middle lift position and decreases as the position of the control shaft 6 changes from the middle lift position to the maximum lift position as shown in FIG. 9B. In consequence, the axial movement amount dL/dθ of the control shaft 6 per rotation angle of the electric motor 21 is relatively small in the minimum valve lift control region and is minimized at around the minimum lift position as shown in FIG. 9C. It is thus possible to allow minute control in the minimum valve lift control region. It is further possible to limit an increase in longitudinal engine length as the electric motor 21 can be mounted so as not to protrude toward the front side or rear side of the engine.

Third Embodiment

The third embodiment is structurally similar to the first embodiment, except that the variable valve system employs a three-dimensional cam so as to change an axial position of the three-dimensional cam by the axial movement of the control shaft 6 and thereby vary the valve lift amount of the intake valve 2 as disclosed in Japanese-Laid Open Patent Publication No. 2000-80907 and U.S. Pat. No. 6,244,229, which is incorporated by reference. Even in this case, it is possible to obtain the same effects as in the first embodiment by the use of the actuator device 8 with the screw shaft 20, the screw nut 22, the transmission shaft 18 and the first and second transmission mechanisms 19 and 23.

Fourth Embodiment

The fourth embodiment is structurally similar to the first embodiment, except that the variable valve system employs another type of variable valve apparatus, as disclosed in Japanese Laid-Open Patent Publication No. 2003-35115, to which the actuator device 8 is applied.

Figure 10:
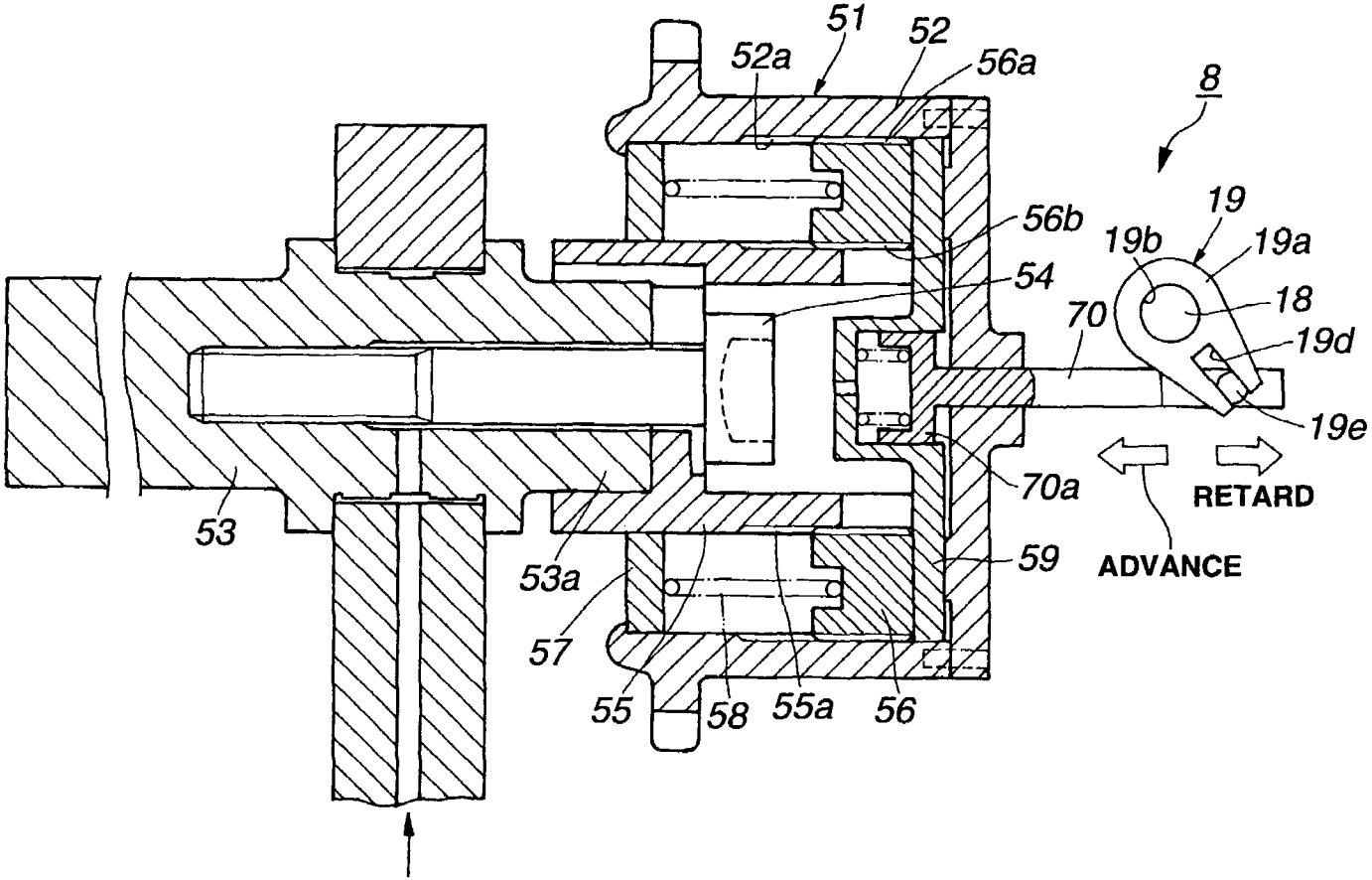
FIG. 10 is a cross-sectional view of substantial part of an actuator device according to a fourth embodiment of the present invention.

As shown in FIG. 10, the variable valve apparatus of the fourth embodiment includes a timing sprocket 51 rotated by a crankshaft of the engine, a sleeve 55 fitted in a cylindrical housing 52 of the timing sprocket 51 and fixed by a bolt 54 to one end 53*a* of a camshaft 53 and an annular piston 56 axially movably disposed around the sleeve 55. Helical gears 56*a*, 56*b*, 52*a* and 55*a* are formed on outer and inner peripheral surfaces of the piston 56, an inner peripheral surface of the housing 52 and an outer peripheral surface of the sleeve 55, respectively, so that the helical gears 56*a* and 56*b* mesh with the helical gears 52*a* and 55*a*. The valve lift timing control apparatus further includes a coil spring 58 arranged between a recessed end of the piston 56 and an end wall 57 to apply a biasing force to the piston 56, a disc-shaped push member 59 axially slidably disposed in the housing 52 to push the piston 56 against the spring force of the coil spring 58 and a control shaft 70 supported at one end portion 70*a* thereof in a center recess 59*a* of the push member 59 and connected at the other end portion of to the transmission shaft 18 of the actuator device 8 through the first transmission mechanism 19. When the actuator device 8 axially moves the control shaft 70 to the left side in FIG. 10, the control shaft 70 pushes the push member 59 and moves the piston 56 against the spring force of the coil spring 58 so as to change the relative phase difference between the timing sprocket 51 and the camshaft 53 through the mesh of the helical gears 56*a* and 56*b* and the helical gears 52*a* and 55*a* and thereby advance the opening/closing timing of the intake valve 2. When the actuator device 8 moves the control shaft 70 axially to the right side in FIG. 10, the control shaft 70 moves the piston 58 under the spring force of the coil spring 58 so as to change the relative phase difference between the timing sprocket 51 and the camshaft 53 and retard the opening/closing timing of the intake valve 2. It is thus possible in the fourth embodiment to obtain the same effects (e.g. power consumption improvement effect) as in the first embodiment. It is also possible to change the intake/exhaust valve overlap of the engine largely for improvement in fuel efficiency through internal EGR control.

The directions of the helical gears 52*a*, 55*a*, 56*a* and 56*b* may alternatively be set opposite to the above so as to retard the opening/closing timing of the intake valve 2 when the control shaft 70 moves to the left side in FIG. 10 and to advance the opening/closing timing of the intake valve 2 when the control shaft 70 moves to the right side in FIG. 10.

Fifth Embodiment

The fifth embodiment is structurally similar to the first embodiment, except that the variable valve system has another type of variable valve apparatus, as disclosed in Japanese Laid-Open Patent Publication No. 2001-248410, to which the actuator device 8 is applied.

Figure 11:
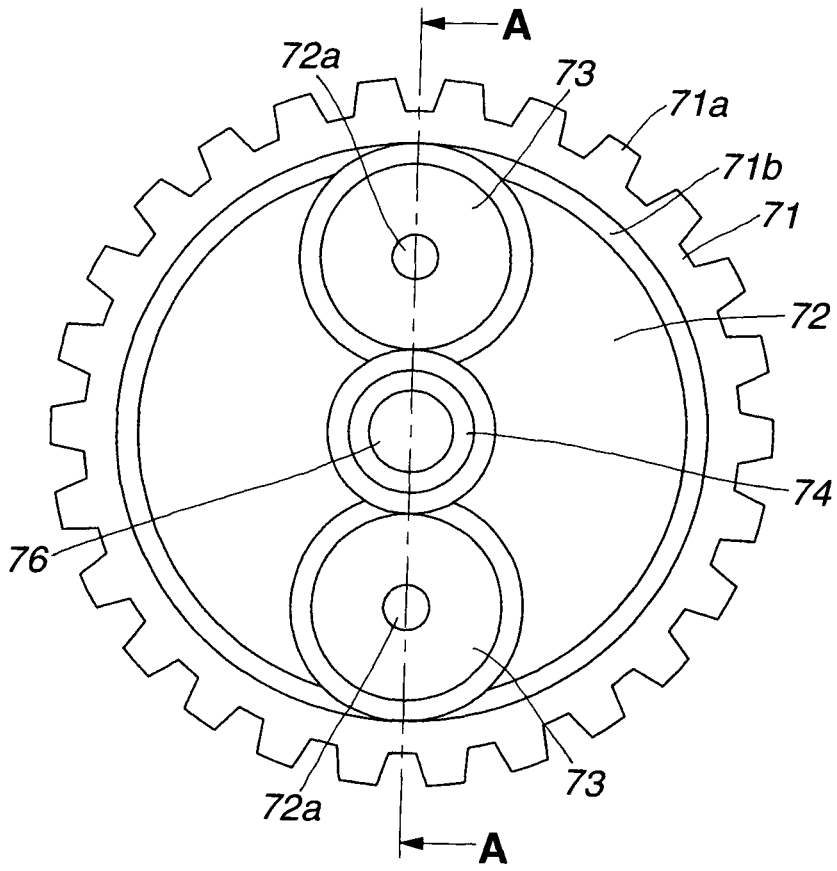
FIG. 11 is an elevational view of substantial part of an actuator device according to a fifth embodiment of the present invention.
Figure 12:
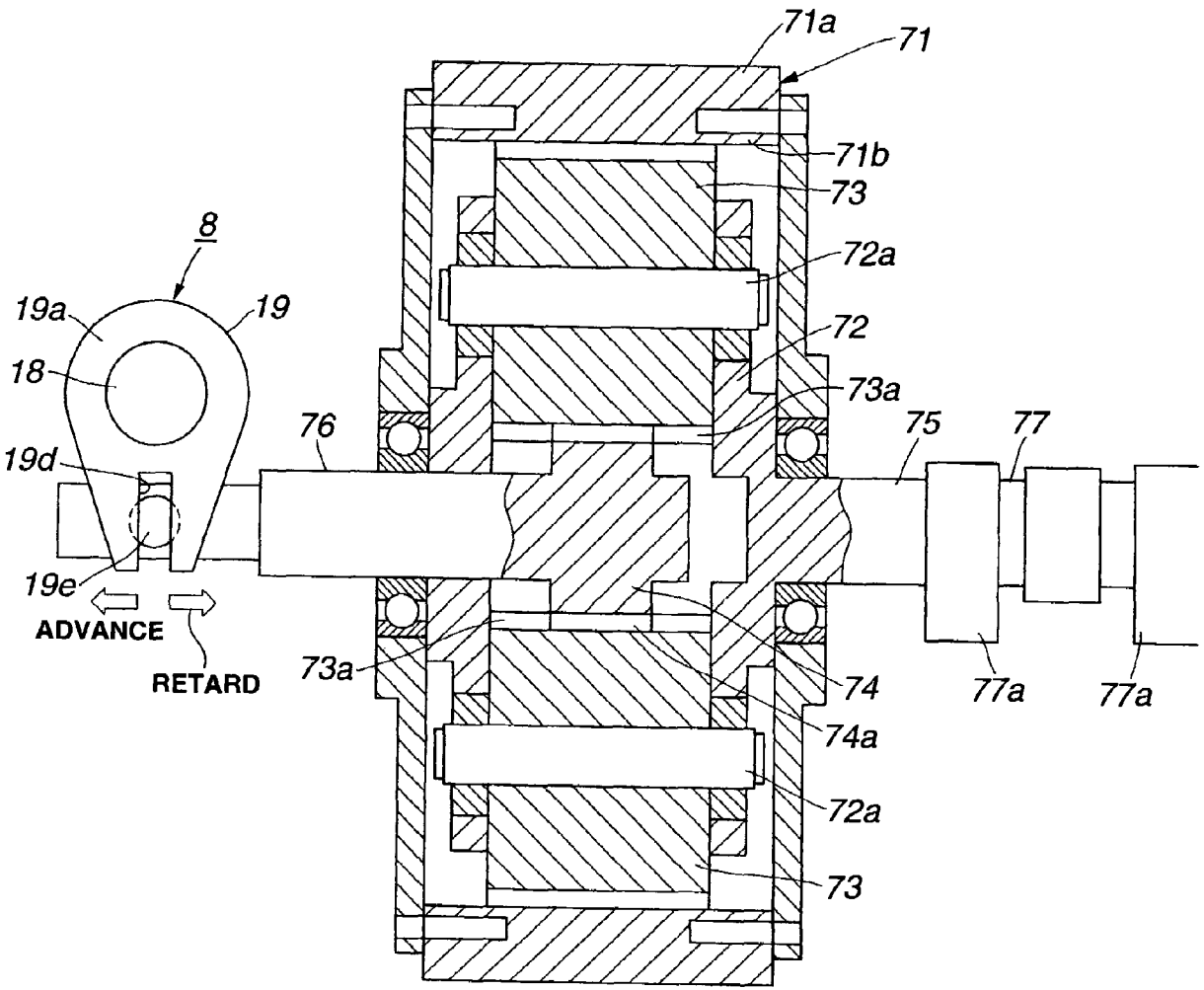
FIG. 12 is a cross-sectional view of the actuator device, taken along line A-A of FIG. 11, according to the fifth embodiment of the present invention.

As shown in FIGS. 11 and 12, the variable valve apparatus of the fifth embodiment includes a carrier 72, an annular pulley 71 arranged around the carrier 72 and connected to a crankshaft by a timing belt, two planet gears 73 fixed to the carrier 72 by shaft members 72*a*, a sun gear 74 disposed between the planet gears 73, an output shaft 75 connected to the carrier 72, a control shaft 76 coaxially connected at one end portion thereof to the sun gear 74 and the other end portion thereof to the transmission shaft 18 of the actuator device 8 through the first transmission mechanism 19 and a camshaft 77 rotatably connected to the output shaft 75 and provided with drive cams 77*a*. A timing gear 71*a* is formed on an outer peripheral surface of the pulley 71 and held in mesh with the timing belt. Further, helical gears 71*b*, 73*a* and 74 on an inner peripheral surface of the pulley 71, outer peripheral surfaces of the planet gears 73 and an outer peripheral surface of the sun gear 74, respectively, so that the helical gears 73*a* mesh with the helical gears 71*b* and 74*a*. Herein, the mesh of the helical gears 73*a* and 74*a* allows axial movement of the sun gear 74 but restricts rotation of the planet gear 73. When the pulley 71 receives rotation of the crankshaft through the timing belt, the planet gears 73 turn around the sun gear 74 to rotate the carrier 72 together with the output shaft 75. Upon the rotation of the output shaft 75, the camshaft 77 (drive cam 77*a*) rotates to open and close the intake valve 2. Further, the actuator device 8 axially moves the control shaft 76 and the sun gear 74 to adjust the opening/closing timing of the intake valve 2 depending on the phase angle between the helical gears 73*a* and 74*a*. In the fifth embodiment, the opening/closing timing of the intake valve 2 becomes advanced when the control shaft 74 moves to the left side in FIG. 12 and becomes retarded when the control shaft 76 moves to the right side in FIG. 12. It is thus possible in the fifth embodiment to obtain the same effects as in the first embodiment.

The directions of the helical gears 71*b*, 73*a* and 74*a* may alternatively be set opposite to the above so as to retard the opening/closing timing of the intake valve 2 when the control shaft 76 moves to the left side in FIG. 12 and to advance the opening/closing timing of the intake valve 2 when the control shaft 76 moves to the right side in FIG. 12.

Sixth Embodiment

Figure 13:
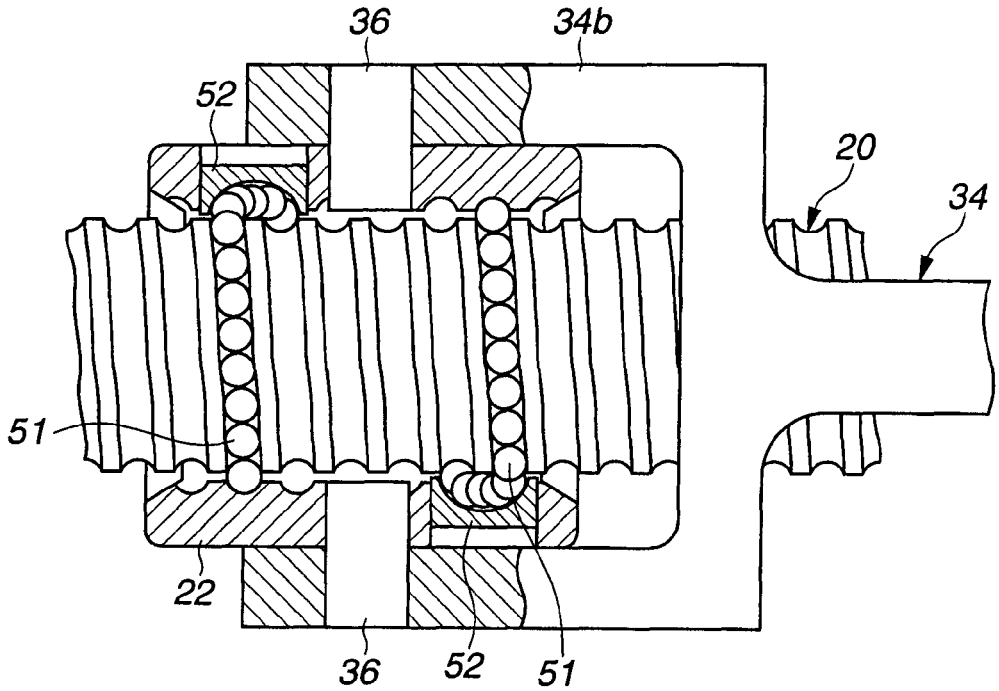
FIG. 13 is a cross-sectional view of substantial part of an actuator device according to a sixth embodiment of the present invention.

The sixth embodiment is structurally similar to the first embodiment, except that the actuator device 8 has a plurality of bearing balls 51 and deflectors 52 arranged between the screw shaft 20 and the screw nut 22 as disclosed in Japanese Laid-Open Patent Publication No. 2007-285306 and as shown in FIG. 13. As the balls 51 support the screw nut 20 axially movably on the screw shaft 22 by rolling in ball rolling grooves of the screw nut 22 and the screw shaft 20, the friction between the screw shaft 20 and the screw nut 22 can be reduced for increased transmission efficiency and conversion response (nut switching response). The lead of the ball rolling grooves of the screw shaft 20 cannot be made so small under the constraints of the diameter (size) of the balls 51. However, the transmission mechanisms 19 and 23 allows a large axial movement amount ΔS of the screw nut 22 even when the axial movement amount ΔL of the control shaft 6 is small. It is thus possible in the sixth embodiment to increase the overall rotation speed of the electric motor 21 sufficiently and obtain the same effects (improvements in power consumption and holding stability) as in the first embodiment.

Seventh Embodiment

The seventh embodiment is structurally similar to the first embodiment, except for the connection structure between the second transmission mechanism 23 and the screw nut 22. In the seventh embodiment, the second connection member of the second transmission mechanism 23 is formed as a protrusion pin on a peripheral side of the screw nut 22 and engaged in a slit of the end portion of the connection arm 33 as disclosed in Japanese Laid-Open Patent Publication No. 2007-285308. Even in this case, it is possible to secure a large axial movement amount ΔS of the screw nut 22 and obtain the same effects as in the first embodiment.

Eighth Embodiment

The eighth embodiment is structurally similar to the first embodiment, except for the connection structure between the control shaft 6 and the first transmission mechanism 19 and the location of the rotational potentiometer 26.

Figure 14A:
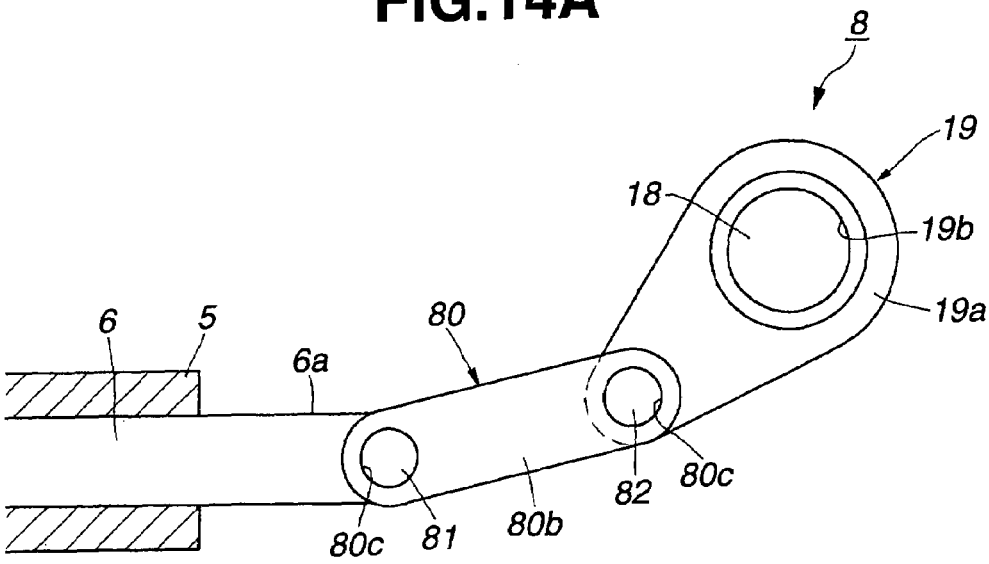
FIGS. 14A and 14B are a side view and a plan view of substantial part of an actuator device according to an eighth embodiment of the present invention.
Figure 14B:
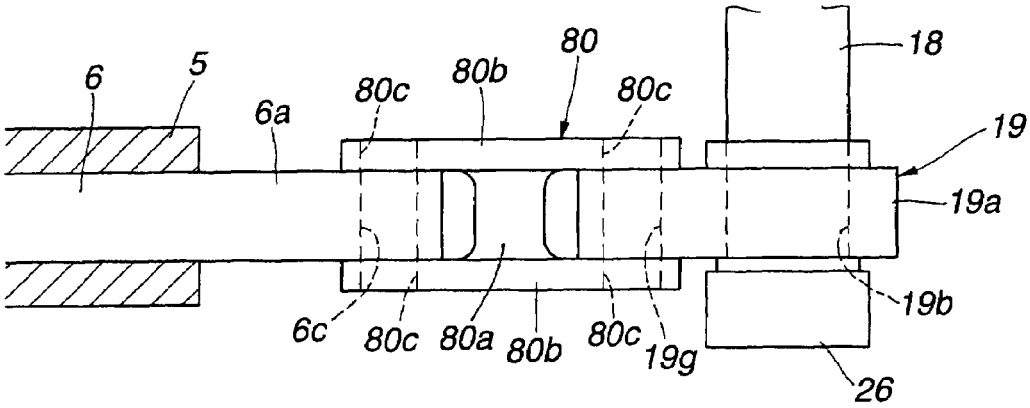

In the eight embodiment, the actuator device 8 adopts a double-link connection structure provided with a link rod 80 (as a second link member) and two connection pins 81 and 82 for connection the link lever 19*a* of the first transmission mechanism 19 to the end portion 6*a* of the control shaft 6 as shown in FIGS. 14A and 14B. The front end portion 6*a* of the control shaft 6 has a cylindrical rod shape with a radial pin insertion hole 6*c*. The link lever 19*a* of the first transmission shaft 18 has a tapered end portion formed with a pin insertion hole 19*g* but with no engagement groove. Further, the link rod 80 has a substantially cylindrical portion 80*a* and a pair of elongated link plates 80*b* arranged in parallel to each other on opposite axial sides of the cylindrical portion 80*a* so as to sandwich the front end portion 6*a* of the control shaft 6 between first end portions of the link plates 80*b* and sandwich the link lever 19*a* between second end portions of the link plates 80*b*. Pin insertion holes 80*c* are formed in the first and second end portions of the link plates 80*b* so as to correspond in position to the pin insertion holes 6*c* and 19*g*. The connection pins 81 and 82 are inserted through the pin insertion holes 6*c* and 8*c* and the pin holes 19*g* and 8*c* so as to rotatably connect the link lever 19*a* to the control shaft 6 via the link rod 80 and the connection pins 81 and 82. This double-link connection structure provides less sliding contact than the pin/groove connection structure of the first embodiment. It is therefore possible in the eighth embodiment to not only obtain the same effects as in the first embodiment but also increase the wear resistance of the control shaft 6 and the link lever 19*a*.

Further, the rotational potentiometer 26 is arranged on a side of the transmission shaft 18 opposite from the second transmission mechanism 23 so as to detect the rotational position of the transmission shaft 18 as shown in FIG. 14B in the eighth embodiment. It is thus possible in the eighth embodiment to protect the transmission shaft 18 from torsional deformation and allow more accurate monitoring of the valve lift characteristics as compared to the first embodiment.

The entire contents of Japanese Patent Application No. 2008-185576 (filed on Jul. 17, 2008) are herein incorporated by reference.

Although the present invention has been described with reference to the above-specific embodiments of the invention, the invention is not limited to these exemplary embodiments. Various modification and variation of the embodiments described above will occur to those skilled in the art in light of the above teachings.

For example, the actuator device 8 can be applied to any type of variable valve apparatus as long as the variable valve apparatus has a control shaft axially linearly movable by the actuator device 8. The configuration of the variable valve system is not particularly limited and can be selected as appropriate depending on the performance required. Also, the connection structure of the control shaft 6 and the first transmission mechanism 19 and the connection structure of the screw nut 22 and the second transmission mechanism 23 are not limited to the above and can be modified as appropriate depending on the size and specifications required.

The scope of the invention is defined with reference to the following claims.

What is claimed is:

1. An actuator device for a variable valve apparatus in a multi-cylinder internal combustion engine, the variable valve apparatus having a control shaft to vary operation characteristics of engine valves by an axial movement of the control shaft, the actuator device comprising:

a rotatable screw shaft;

a movable member axially movable with rotation of the rotatable screw shaft; and a transmission mechanism unit that converts an axial movement of the movable member to the axial movement of the control shaft, wherein a maximum amount of the axial movement of the movable member is larger than an amount of the axial movement of the control shaft; and wherein the transmission mechanism unit has an engagement groove formed therein in a radial direction of a transmission shaft and a protrusion formed on an end portion of the control shaft and engaged in the engagement groove.

2. The actuator device according to claim 1, wherein the protrusion has two parallel cut surfaces formed on an outer periphery of the protrusion and held in sliding contact with lateral surfaces of the engagement groove.

3. An actuator device for moving a control shaft in an axial direction of the control shaft to control operating characteristics of an engine valve, comprising:

a transmission shaft rotatably supported in a direction substantially perpendicular to the control shaft;

a screw shaft rotatably supported in a direction substantially perpendicular to the transmission shaft;

a drive unit that rotates the screw shaft;

a movable member axially movable with rotation of the screw shaft;

a first transmission mechanism that converts rotation of the transmission shaft to an axial movement and transmits the axial movement to the control shaft; and a second transmission mechanism that converts an axial movement of the movable member to rotation and transmits the rotation to the transmission shaft;

wherein the transmission shaft has bearings on opposite sides of the first transmission mechanism.

4. The actuator device according to claim 3, wherein the actuator device changes an amount of the axial movement of the control shaft per rotation angle of the screw shaft depending on a position of the control shaft.

5. The actuator device according to claim 4, wherein the actuator device decreases the amount of the axial movement of the control shaft per rotation angle of the screw shaft at both ends of a movable range of the control shaft.

6. The actuator device according to claim 3, further comprising:

a position detection unit that detects a rotation angle of the transmission shaft and outputs a detection signal responsive to the detected rotation angle of the transmission shaft; and a controller that controls the drive unit based on the detection signal of the position detection unit.

7. The actuator device according to claim 3, wherein the control shaft controls a valve lift amount of the engine valve with the axial movement of the control shaft.

8. The actuator device according to claim 7, wherein the amount of the axial movement of the control shaft per rotation angle of the screw shaft is minimized during maximum valve lift control.

9. The actuator device according to claim 7, wherein the amount of the axial movement of the control shaft per rotation angle of the screw shaft is minimized during minimum valve lift control.

10. The actuator device according to claim 7, wherein the amount of the axial movement of the control shaft per rotation angle of the screw shaft is maximized when the control shaft is in a middle position between maximum and minimum lift positions.

11. The actuator device according to claim 3, wherein the control shaft controls opening/closing timing of the engine valve by the axial movement of the control shaft.

12. The actuator device according to claim 3, further comprising a plurality of balls arranged between the screw shaft and the movable member.

13. The actuator device according to claim 3, wherein the second transmission mechanism has a first connection member on the transmission shaft at a position radially away from a rotation center of the transmission shaft, a second connection member on the movable member and a link member connecting the first and second connection members.

14. The actuator device according to claim 3, wherein the control shaft and the screw shaft are arranged substantially in parallel with a row of cylinders in an internal combustion engine.

15. The actuator device according to claim 14, wherein the drive unit has an electric motor arranged on an inner side of the transmission shaft in the internal combustion engine.

16. An actuator device for moving a control shaft in an axial direction of the control shaft to control operating characteristics of an engine valve, comprising:

a transmission shaft rotatably supported in a direction substantially perpendicular to the control shaft;

a screw shaft rotatably supported in a direction substantially perpendicular to the transmission shaft;

a drive unit that rotates the screw shaft;

a movable member axially movable with rotation of the screw shaft;

a first transmission mechanism that converts rotation of the transmission shaft to an axial movement and transmits the axial movement to the control shaft; and a second transmission mechanism that converts an axial movement of the movable member to rotation and transmits the rotation to the transmission shaft, wherein the first transmission mechanism has an engagement groove formed therein in a radial direction of the transmission shaft and a protrusion on an end portion of the control shaft and engaged in the engagement groove.

17. The actuator device according to claim 16, wherein the protrusion has two parallel cut surfaces on an outer periphery of the protrusion and held in sliding contact with lateral surfaces of the engagement groove.

* * * * *